US009934749B2

(12) United States Patent
Yu

(10) Patent No.: US 9,934,749 B2
(45) Date of Patent: Apr. 3, 2018

(54) COMPLEMENTARY GATE DRIVER ON ARRAY CIRCUIT EMPLOYED FOR PANEL DISPLAY

(71) Applicant: Shenzhen China Star Optoelectronics Technology Co., Ltd., Shenzhen, Guangdong (CN)

(72) Inventor: Xiaojiang Yu, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 0 days.

(21) Appl. No.: 15/617,663

(22) Filed: Jun. 8, 2017

(65) Prior Publication Data

US 2017/0270886 A1 Sep. 21, 2017

Related U.S. Application Data

(63) Continuation-in-part of application No. 14/382,302, filed on Aug. 29, 2014, now abandoned.

(51) Int. Cl.
*G09G 3/36* (2006.01)

(52) U.S. Cl.
CPC ... *G09G 3/3677* (2013.01); *G09G 2310/0286* (2013.01); *G09G 2310/0289* (2013.01); *G09G 2310/08* (2013.01)

(58) Field of Classification Search
CPC ..... G09G 3/3677; G09G 2310/0286; G09G 2310/0245; G09G 2330/045; G09G 2330/025; G09G 2330/027; G09G 2300/0426; G09G 2320/0223
USPC ..... 345/82, 87, 98, 99, 100, 204–205, 206, 345/212; 327/108
See application file for complete search history.

(56) References Cited

U.S. PATENT DOCUMENTS 6,959,271 B1 * 10/2005 Ballam ..... G06F 17/5022 703/14
2012/0105393 A1 * 5/2012 Tan ..... G09G 3/3677 345/204
2015/0002504 A1 * 1/2015 Jo ..... G09G 3/3677 345/213

* cited by examiner

*Primary Examiner* — Stacy Khoo
(74) *Attorney, Agent, or Firm* — Andrew C. Cheng

(57) ABSTRACT

A complementary gate driver on array circuit employed for panel display includes a plurality of GOA units that are cascade connected, in which an nth GOA unit controls charge to an nth horizontal scanning line G(n) in a display area and includes a pull-up circuit module, a pull-down circuit module, a pull-down holding circuit module, a pull-up controlling circuit module, a pull-down circuit module of an nth gate signal point Q(n), and a bootstrap capacitor. The pull-up circuit module, the pull-down circuit module, the pull-down holding circuit module, the pull-down circuit module of the nth gate signal point Q(n), and the bootstrap capacitor are respectively coupled to the nth gate signal point Q(n) and the nth horizontal scanning line G(n), and the pull-up controlling circuit module is coupled to the nth horizontal scanning line G(n).

9 Claims, 6 Drawing Sheets

COMPLEMENTARY GATE DRIVER ON ARRAY CIRCUIT EMPLOYED FOR PANEL DISPLAY

CROSS REFERENCE TO RELATED APPLICATIONS

This is a continuation-in-part application of co-pending patent application Ser. No. 14/382,302, filed on Aug. 29, 2014, which is a national stage of PCT Application Number PCT/CN2014/082530, filed on Jul. 18, 2014, claiming foreign priority of Chinese Patent Application Number 201410318442.0, filed on Jul. 4, 2014.

BACKGROUND OF THE INVENTION

1. Field of the Invention

The present invention relates to a display skill field, and more particularly to a complementary gate driver on array circuit employed for panel display.

2. The Related Arts

GOA (Gate Driver on Array) skill is to integrate the TFT (Thin Film Transistor) of a gate driving circuit on the array substrate and to eliminate the integrated circuit part of the gate driving circuit located outside the array substrate. Accordingly, two aspects of material cost and process is considered to reduce the manufacture cost of the productions. GOA skill is a common gate driving circuit skill used in a present TFT-LCD (Thin Film Transistor-Liquid Crystal Display). The manufacture process is simple and provides great application possibilities. The functions of the GOA circuit mainly comprises: the present gate line outputs a high level signal with charging the capacitor of the shift register unit by using the high level signal outputted from the previous gate line, and then reset is achieved by using the high level signal outputted from the next gate line.

GOA technology is to utilize present manufacture processes of display panel to manufacture the driving circuit of controlling the horizontal scanning lines on the substrate around the panel display area for replacing an IC (integrated circuit) to achieve driving horizontal scanning lines. The GOA technology can simplify the manufacture processes of the display panel and reduce the manufacture cost. Meanwhile, it is capable of allowing a display panel to be more applicable for narrow frame or non frame panel display products. Recently, it has been widely applied in the panel display field.

Please refer to FIG. 1, which is a single level structural diagram of a GOA circuit employed in panel display according to prior art. It comprises: a plurality of gate driver on array unit which are cascade connected, and a nth gate driver on array unit controls charge to a nth horizontal scanning line G(n) in a display area, and the nth gate driver on array unit comprises a pull-up circuit module 100, a pull-down circuit module 200, a pull-down holding circuit module 300, a pull-up controlling circuit module 400, a pull-down circuit module 500 of a nth gate signal point Q(n), and a bootstrap capacitor Cb; the pull-up circuit module 100, the pull-down circuit module 300 and the bootstrap capacitor Cb are respectively coupled to the nth gate signal point Q(n) and the nth horizontal scanning line G(n), and the pull-up controlling circuit module 400 and the pull-down circuit module 500 of the nth gate signal point Q(n) are respectively coupled to the nth gate signal point Q(n);

the pull-up circuit module 100 comprises: a thin film transistor directly controlling the charge to the nth horizontal scanning line G(n) in the display area, and a gate of the thin film transistor T21 is electrically coupled to the nth gate signal point Q(n), and a source and a drain of the thin film transistor T21 are respectively inputted with a nth clock CK(n) and coupled to the nth horizontal scanning line G(n), and a voltage level at the nth gate signal point Q(n) of the gate of the thin film transistor T21 directly affects the charge to the nth horizontal scanning line G(n) by the nth clock CK(n);

the pull-down circuit module 200 comprises: a thin film transistor T41 discharging the nth horizontal scanning line G(n) as the charge is accomplished; a gate of the thin film transistor T41 is electrically coupled to the n+2th horizontal scanning line G(n+2), and a drain and a source of the thin film transistor T41 are respectively connected to the nth gate signal point Q(n) and an input DC low voltage VSS; the thin film transistor T41 is activated for discharging when the n+2th horizontal scanning line G(n+2) is at high voltage level;

a set of thin film transistors in the pull-down holding circuit module 300 is capable of keeping the nth gate signal point Q(n) and the nth horizontal scanning line G(n) at low voltage level in a non-charge period and the pull-down holding circuit module 300 comprises: a thin film transistor T32, and a gate of the thin film transistor T32 is electrically coupled to a first circuit point P, and a drain and a source are respectively coupled to the nth horizontal scanning line G(n) and the input DC low voltage VSS; a thin film transistor T33, and a gate of the thin film transistor T33 is electrically coupled to a second circuit point K, and a drain and a source are respectively coupled to the nth horizontal scanning line G(n) and the input DC low voltage VSS; a thin film transistor T42, and a gate of the thin film transistor T42 is electrically coupled to the first circuit point P, and a drain and a source are respectively coupled to the nth horizontal scanning line G(n) and the nth gate signal point Q(n); a thin film transistor T43, and a gate of the thin film transistor T43 is electrically coupled to a second circuit point K, and a drain and a source are respectively coupled to the nth horizontal scanning line G(n) and the nth gate signal point Q(n); a thin film transistor T52, and a gate of the thin film transistor T52 is electrically coupled to the nth gate signal point Q(n), and a drain and a source are respectively coupled to the first circuit point P and the input DC low voltage VSS; a thin film transistor T62, and a gate of the thin film transistor T62 is electrically coupled to the nth gate signal point Q(n), and a drain and a source are respectively coupled to the second circuit point K and the input DC low voltage VSS; a thin film transistor T53, and a gate of the thin film transistor T53 is inputted with a first low frequency clock LC1, and a drain and a source are respectively inputted with the first low frequency clock LC1 and coupled to the first circuit point P; a thin film transistor T54, and a gate of the thin film transistor T54 is inputted with a second low frequency clock LC2, and a drain and a source are respectively inputted with the first low frequency clock LC1 and coupled to the first circuit point P; a thin film transistor T63, and a gate of the thin film transistor T63 is inputted with the second low frequency clock LC2, and a drain and a source are respectively inputted with the second low frequency clock LC2 and coupled to the second circuit point K; a thin film transistor T64, and a gate of the thin film transistor T64 is inputted with the first low frequency clock LC1, and a drain and a source are respectively inputted with the second low frequency clock LC2 and coupled to the second circuit point K;

the pull-up controlling circuit module 400 comprises a thin film transistor T11, and a gate of the thin film transistor T11 is inputted with a activating signal ST(n−2) from the n−2th GOA unit, and a drain and a source are respectively coupled to a n−2th horizontal scanning line G(n−2) and the nth gate signal point Q(n);

the pull-down circuit module 500 of the nth gate signal point Q(n) comprises a thin film transistor T22, and a gate of the thin film transistor T22 is electrically coupled to the nth gate signal point Q(n), and a drain and a source respectively is inputted with a nth clock CK(n) and outputs a activating signal ST(n).

As functioning, the first circuit point P and the second circuit point K of the pull-down holding circuit module 300 are alternatively charged by the first low frequency clock LC1 and the second low frequency clock LC2 and at a high voltage level, and accordingly to alternatively control activation of the thin film transistor T32 and T42 or activation of the thin film transistor T33 and T43. Then, the nth horizontal scanning line G(n) and the nth gate signal point Q(n) can be kept at a low voltage level in a non-charge period and the thin film transistor from influence of the gate voltage stress in a long period of time can be prevented; the thin film transistor T52 and the thin film transistor T62 are activated as the nth gate signal point Q(n) is at high voltage level, and the voltage level at the first circuit point P, the second circuit point K are pulled down to deactivate the thin film transistor T32, the thin film transistor T42, the thin film transistor T33, the thin film transistor T43 for not to affect the charge to the nth horizontal scanning line G(n) and the nth gate signal point Q(n); the thin film transistor T11 and the thin film transistor T22 can control and transmit the activating signal ST of the former GOA circuit to the present GOA circuit to allow the GOA circuit to be charged or discharged from level to level; a bootstrap capacitor Cb with bootstrap function is coupled between the nth gate signal point Q(n) and the nth horizontal scanning line G(n). The voltage level of the nth gate signal point Q(n) can be raised with the coupling effect of the bootstrap capacitor Cb1 when the voltage of the nth horizontal scanning line G(n) is raised. Accordingly, a higher voltage level of the nth gate signal point Q(n) and a smaller RC delay of the GOA charging signal can be obtained.

As shown in FIG. 1, fourteen thin film transistor (TFT) elements are required in a GOA circuit unit of a single level structural GOA circuit employed in panel display.

For most of the preset GOA circuits, such as the GOA circuit illustrated in FIG. 1, the peak voltage level of the gate of the thin film transistor T11 in the pull-up controlling circuit module 400 is approximately equal to the voltage level $V_{G(n-2)}$ of the n−2th horizontal scanning line G(n−2), therefore, the nth gate signal point Q(n) can be charged to be about $V_{G(n-2)}$−Vth, the voltage level of the nth gate signal point Q(n) is charged to the voltage level which can be easily influenced by the threshold voltage Vth drift of the thin film transistor T11.

Please refer to FIG. 2, which is a multi-level structural diagram of a GOA circuit employed in panel display according to prior art. FIG. 2 depicts a multi-level connection method of the complementary GOA circuit employed in panel display according to prior art. The metal lines of a low frequency clock of the first low frequency clock LC1 and the second low frequency clock LC2, a direct current low voltage VSS and four high frequency clock CK1-CK4 are located at the two sides of the panel outside the GOA circuit of the respective levels. A plurality of data lines providing data signals, a plurality of scan lines providing scan signals, a plurality of pixels P are arranged in array, and each of pixel P is electrically coupled to one data line and one scan line, a plurality of shift registers are arranged in sequence S(n−3), S(n−2), S(n−1), S(n). Each shift register outputs a gate signal for scanning the corresponding scan line (gate line) in the display device. Each shift register is electrically coupled to the first low frequency clock LC1, the second low frequency clock LC2, the direct current low voltage VSS and one of the four high frequency clock CK1-CK4. Specifically, the nth GOA circuit respectively receives the first low frequency clock LC1, the second low frequency clock LC2, the direct current low voltage VSS, one of the four high frequency clock CK1-CK4, a n−2th gate signal and the activating signal ST(n−2) generated by the n−2th GOA circuit, a G(n+2) signal generated by the n+2th GOA circuit, and generates a G(n) signal, a ST(n) signal and a Q(n) signal.

Thus, more thin film transistor elements are used in the GOA circuit employed in panel display according to according prior art and two metal lines are required at both the left side and at the right side for transmitting the first low frequency clock LC1 and the second low frequency clock LC2. It counts against the reduction of the manufacture cost and bad for reducing the dimension of the GOA circuits.

SUMMARY OF THE INVENTION

An objective of the present invention is to provide a complementary gate driver on array circuit employed for panel display, capable of reducing the dimension of the pull-down holding circuit module in the GOA circuit. The dimension-reduced GOA circuit can be realized. Then, such GOA circuit is applicable for narrow frame or non frame panel display products.

For realizing the aforesaid objective, the present invention provides a complementary gate driver on array circuit employed for panel display, comprising: a plurality of gate driver on array unit which are cascade connected, and a nth gate driver on array unit controls charge to a nth horizontal scanning line G(n) in a display area, and the nth gate driver on array unit comprises a pull-up circuit module, a pull-down circuit module, a pull-down holding circuit module, a pull-up controlling circuit module, a pull-down circuit module of a nth gate signal point Q(n), and a bootstrap capacitor Cb1; the pull-up circuit module, the pull-down circuit module, the pull-down holding circuit module, the pull-down circuit module of the nth gate signal point Q(n), and the bootstrap capacitor Cb1 are respectively coupled to the nth gate signal point Q(n) and the nth horizontal scanning line G(n), and the pull-up controlling circuit module is coupled to the nth horizontal scanning line G(n).

The pull-up circuit module comprises: a thin film transistor directly controlling the charge to the nth horizontal scanning line G(n) in the display area, and a gate of the thin film transistor T1 is electrically coupled to the nth gate signal point Q(n), and a source and a drain of the thin film transistor T1 are respectively inputted with a nth clock CK(n) and coupled to the nth horizontal scanning line G(n), and a voltage level at the nth gate signal point Q(n) of the gate of the thin film transistor T1 directly affects the charge to the nth horizontal scanning line G(n) by the nth clock CK(n).

The pull-down circuit module comprises: a thin film transistor T3 discharging the nth horizontal scanning line G(n) as the charge is accomplished and a thin film transistor T4 discharging the nth gate signal point Q(n); a gate of the thin film transistor T3 is electrically coupled to the n+2th horizontal scanning line G(n+2), and a drain and a source are respectively connected to the nth horizontal scanning line G(n) and an input DC low voltage VSS; a gate of the thin film transistor T4 is electrically coupled to the n+2th horizontal scanning line G(n+2), and a drain and a source of the thin film transistor T4 are respectively connected to the nth gate signal point Q(n) and the input DC low voltage VSS, the thin film transistor T3 and the thin film transistor T4 are activated for discharging when the n+2th horizontal scanning line G(n+2) is at high voltage level.

The pull-down holding circuit module comprises: a thin film transistor T5, and a gate of the thin film transistor T5 is electrically coupled to a first circuit point P1, and a drain and a source are respectively coupled to the nth horizontal scanning line G(n) and an input DC low voltage VSS; a thin film transistor T6, and a gate of the thin film transistor T6 is electrically coupled to the nth gate signal point Q(n), and a drain and a source are respectively coupled to the second circuit point K1 and the input DC low voltage VSS; a thin film transistor, and a gate of the thin film transistor T7 is electrically coupled to a nth gate signal point, and a drain and a source are respectively coupled to the first circuit point P1 and the input DC low voltage VSS; a thin film transistor T8, and a gate of the thin film transistor T8 is electrically coupled to a second circuit point K1, and a drain is inputted with a first low frequency clock LC1 or a second low frequency clock LC2, and a source is electrically coupled to the first circuit point P; a thin film transistor T9, and a gate of the thin film transistor T9 is inputted with the first low frequency clock LC1 or the second low frequency clock LC2, and a drain is inputted with the first low frequency clock LC1 or the second low frequency clock LC2, and a source is electrically coupled to the second circuit point K1.

The first circuit point P1 can be at high voltage level by being periodically charged by the first low frequency clock LC1 or the second low frequency clock LC2 to control activation of the thin film transistor T5 for keeping the nth horizontal scanning line G(n) at low voltage level in a non-charge period; the thin film transistor T6 and the thin film transistor T7 are activated as the nth gate signal point Q(n) is at high voltage level, and the voltage level at the first circuit point P1 is pulled down to deactivate the thin film transistor T5 for not to affect the charge to the nth horizontal scanning line G(n).

The pull-up controlling circuit module comprises a thin film transistor T10, and a gate of the thin film transistor T10 is inputted with a n−3th gate signal point Q(n−3), and a drain and a source are respectively coupled to a n−2th horizontal scanning line G(n−2) and the nth gate signal point Q(n), and the n−3th gate signal point Q(n−3) controls activation of the thin film transistor T10 in charge of signal transmission between the former and the latter levels in the gate driver on array circuit.

The pull-down circuit module of the nth gate signal point Q(n) comprises a thin film transistor T0, and a gate of the thin film transistor T0 is inputted with a nth clock CK(n), and a drain and a source are respectively coupled to the nth gate signal point Q(n) and the nth horizontal scanning line G(n).

The GOA unit employs ten thin film transistor elements.

Either at the left side or at the right side of the panel, one metal line is required to transmit the first low frequency clock LC1 or the second low frequency clock LC2.

Either as the first low frequency clock LC1 is activated or as the second low frequency clock LC2 is activated, a waveform of the nth horizontal scanning line G(n) can normally output and the waveform of the nth horizontal scanning line G(n) under two conditions are basically coincident in a simulation of Eldo SPICE software.

The present invention further provides a complementary gate driver on array circuit employed for panel display, comprising: a plurality of gate driver on array unit which are cascade connected, and a nth gate driver on array unit controls charge to a nth horizontal scanning line G(n) in a display area, and the nth gate driver on array unit comprises a pull-up circuit module, a pull-down circuit module, a pull-down holding circuit module, a pull-up controlling circuit module, a pull-down circuit module of a nth gate signal point Q(n), and a bootstrap capacitor Cb1; the pull-up circuit module, the pull-down circuit module, the pull-down holding circuit module, the pull-down circuit module of the nth gate signal point Q(n), and the bootstrap capacitor Cb1 are respectively coupled to the nth gate signal point Q(n) and the nth horizontal scanning line G(n), and the pull-up controlling circuit module is coupled to the nth horizontal scanning line G(n);

the pull-up circuit module comprises: a thin film transistor directly controlling the charge to the nth horizontal scanning line G(n) in the display area, and a gate of the thin film transistor T1 is electrically coupled to the nth gate signal point Q(n), and a source and a drain of the thin film transistor T1 are respectively inputted with a nth clock CK(n) and coupled to the nth horizontal scanning line G(n), and a voltage level at the nth gate signal point Q(n) of the gate of the thin film transistor T1 directly affects the charge to the nth horizontal scanning line G(n) by the nth clock CK(n);

the pull-down circuit module comprises: a thin film transistor T3 discharging the nth horizontal scanning line G(n) as the charge is accomplished and a thin film transistor T4 discharging the nth gate signal point Q(n); a gate of the thin film transistor T3 is electrically coupled to the n+2th horizontal scanning line G(n+2), and a drain and a source are respectively connected to the nth horizontal scanning line G(n) and an input DC low voltage VSS; a gate of the thin film transistor T4 is electrically coupled to the n+2th horizontal scanning line G(n+2), and a drain and a source of the thin film transistor T4 are respectively connected to the nth gate signal point Q(n) and the input DC low voltage VSS, the thin film transistor T3 and the thin film transistor T4 are activated for discharging when the n+2th horizontal scanning line G(n+2) is at high voltage level;

the pull-down holding circuit module comprises: a thin film transistor T5, and a gate of the thin film transistor T5 is electrically coupled to a first circuit point P1, and a drain and a source are respectively coupled to the nth horizontal scanning line G(n) and the input DC low voltage VSS; a thin film transistor T6, and a gate of the thin film transistor T6 is electrically coupled to the nth gate signal point Q(n), and a drain and a source are respectively coupled to the second circuit point K1 and the input DC low voltage VSS; a thin film transistor, and a gate of the thin film transistor T7 is electrically coupled to a nth gate signal point, and a drain and a source are respectively coupled to the first circuit point P1 and the input DC low voltage VSS; a thin film transistor T8, and a gate of the thin film transistor T8 is electrically coupled to a second circuit point K1, and a drain is inputted with a first low frequency clock LC1 or a second low frequency clock LC2, and a source is electrically coupled to the first circuit point P; a thin film transistor T9, and a gate of the thin film transistor T9 is inputted with the first low frequency clock LC1 or the second low frequency clock LC2, and a drain is inputted with the first low frequency clock LC1 or the second low frequency clock LC2, and a source is electrically coupled to the second circuit point K1;

the first circuit point P1 can be at high voltage level by being periodically charged by the first low frequency clock LC1 or the second low frequency clock LC2 to control activation of the thin film transistor T5 for keeping the nth horizontal scanning line G(n) at low voltage level in a non-charge period; the thin film transistor T6 and the thin film transistor T7 are activated as the nth gate signal point Q(n) is at high voltage level, and the voltage level at the first circuit point P1 is pulled down to deactivate the thin film transistor T5 for not to affect the charge to the nth horizontal scanning line G(n);

the pull-up controlling circuit module comprises a thin film transistor T10, and a gate of the thin film transistor T10 is inputted with a n−3th gate signal point Q(n−3), and a drain and a source are respectively coupled to a n−2th horizontal scanning line G(n−2) and the nth gate signal point Q(n), and the n−3th gate signal point Q(n−3) controls activation of the thin film transistor T10 in charge of signal transmission between the former and the latter levels in the gate driver on array circuit;

the pull-down circuit module of the nth gate signal point Q(n) comprises a thin film transistor T0, and a gate of the thin film transistor T0 is inputted with a nth clock CK(n), and a drain and a source are respectively coupled to the nth gate signal point Q(n) and the nth horizontal scanning line G(n);

the GOA unit employs ten thin film transistor elements;

either at the left side or at the right side of the panel, one metal line is required to transmit the first low frequency clock LC1 or the second low frequency clock LC2;

either as the first low frequency clock LC1 is activated or as the second low frequency clock LC2 is activated, a waveform of the nth horizontal scanning line G(n) can normally output and the waveform of the nth horizontal scanning line G(n) under two conditions are basically coincident in a simulation of Eldo SPICE software.

The benefits of the present invention are: in the complementary gate driver on array circuit employed for panel display of the present invention, by a method of performing compensation with the pull-down holding circuit modules (G(n) pull down) of the GOA circuit at the left and the right sides of the display panel, the dimension of the pull-down holding circuit module of the GOA circuit can be reduced. Accordingly, the size of the GOA circuit is reduced. The dimension-reduced GOA circuit can be realized. Then, such GOA circuit is applicable for narrow frame or non frame panel display products. Meanwhile, the chance that the GOA circuit area is influenced with the dust in the manufacture processes of the display panel can be decreased and it is beneficial for promoting the yield of the panel. Meanwhile, in comparison with the major method of prior arts, the transmission method between the former and the latter levels according to the present invention is improved. With a n−3th gate signal point Q(n−3) to control activation of the thin film transistor in charge of signal transmission between the former and the latter levels in the GOA circuit, the influence to the signal transmission between the former and the latter levels in the GOA circuit caused by the threshold voltage drift of the thin film transistor can be smaller than the method in prior arts. Therefore, the influence to the output of the GOA circuit caused by the threshold voltage drift of the thin film transistor can get smaller. The GOA circuit of the present invention can be applied for manufacturing the narrow frame or non frame panel display products.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution, as well as beneficial advantages, of the present invention will be apparent from the following detailed description of an embodiment of the present invention, with reference to the attached drawings.

In the drawing.

DETAILED DESCRIPTION OF THE PREFERRED EMBODIMENTS

Embodiments of the present invention are described in detail with the technical matters, structural features, achieved objects, and effects with reference to the accompanying drawings as follows.

Figure 3:
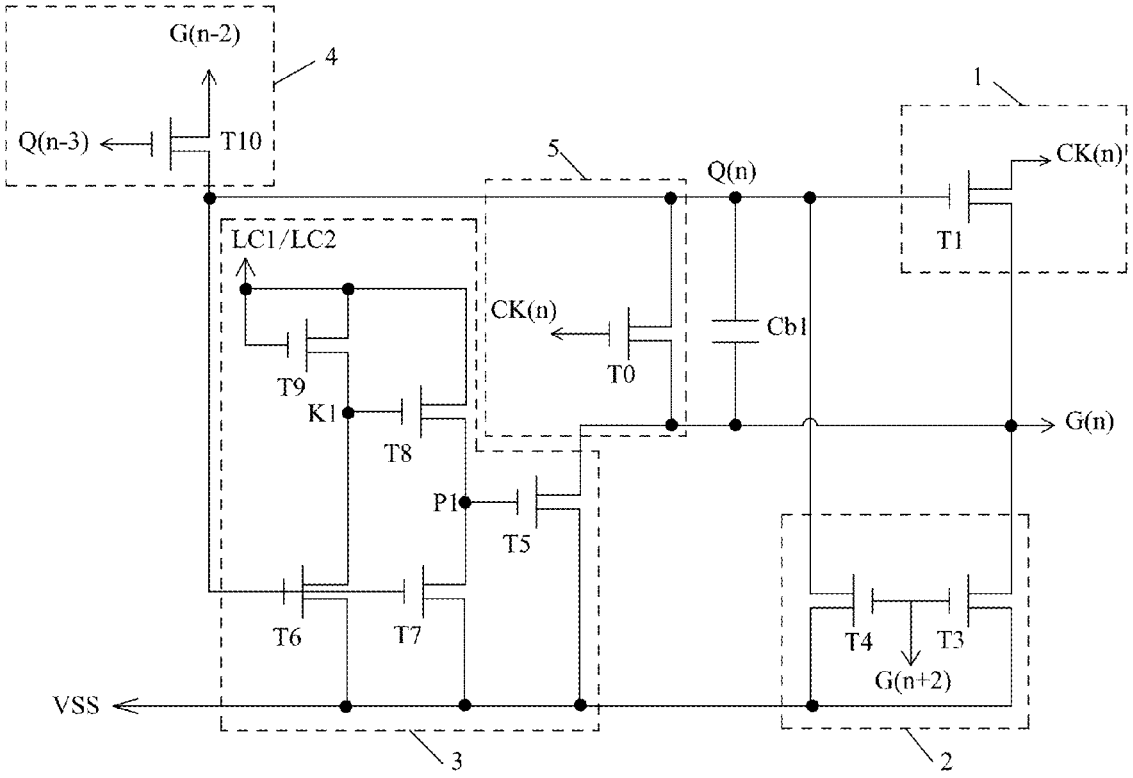
FIG. 3 is a single level structural diagram of a complementary GOA circuit employed in panel display according to the present invention.

Please refer to FIG. 3, which is a single level structural diagram of a complementary GOA circuit employed in panel display according to the present invention. The complementary GOA circuit comprises: a plurality of GOA unit which are cascade connected, and a nth GOA unit controls charge to a nth horizontal scanning line G(n) in a display area, and the nth GOA unit comprises a pull-up circuit module 1, a pull-down circuit module 2, a pull-down holding circuit module 3, a pull-up controlling circuit module 4, a pull-down circuit module 5 of a nth gate signal point Q(n), and a bootstrap capacitor Cb1; the pull-up circuit module 1, the pull-down circuit module 2, the pull-down holding circuit module 3, the pull-down circuit module 5 of the nth gate signal point Q(n), and the bootstrap capacitor Cb1 are respectively coupled to the nth gate signal point Q(n) and the nth horizontal scanning line G(n), and the pull-up controlling circuit module 4 is coupled to the nth horizontal scanning line G(n);

the pull-up circuit module 1 comprises: a thin film transistor directly controlling the charge to the nth horizontal scanning line G(n) in the display area, and a gate of the thin film transistor T1 is electrically coupled to the nth gate signal point Q(n), and a source and a drain of the thin film transistor T1 are respectively inputted with a nth clock CK(n) and coupled to the nth horizontal scanning line G(n), and a voltage level at the nth gate signal point Q(n) of the gate of the thin film transistor T1 directly affects the charge to the nth horizontal scanning line G(n) by the nth clock CK(n);

the pull-down circuit module 2 comprises: a thin film transistor T3 discharging the nth horizontal scanning line G(n) as the charge is accomplished and a thin film transistor T4 discharging the nth gate signal point Q(n); a gate of the thin film transistor T3 is electrically coupled to the n+2th horizontal scanning line G(n+2), and a drain and a source are respectively connected to the nth horizontal scanning line G(n) and an input DC low voltage VSS; a gate of the thin film transistor T4 is electrically coupled to the n+2th horizontal scanning line G(n+2), and a drain and a source of the thin film transistor T4 are respectively connected to the nth gate signal point Q(n) and the input DC low voltage VSS, the thin film transistor T3 and the thin film transistor T4 are activated for discharging when the n+2th horizontal scanning line G(n+2) is at high voltage level;

a set of thin film transistors in the pull-down holding circuit module 3 is capable of keeping the nth horizontal scanning line G(n) at low voltage level in a non-charge period and the pull-down holding circuit module 3 comprises: a thin film transistor T5, and a gate of the thin film transistor T5 is electrically coupled to a first circuit point P1, and a drain and a source are respectively coupled to the nth horizontal scanning line G(n) and the input DC low voltage VSS; a thin film transistor T6, and a gate of the thin film transistor T6 is electrically coupled to the nth gate signal point Q(n), and a drain and a source are respectively coupled to the second circuit point K1 and the input DC low voltage VSS; a thin film transistor T7, and a gate of the thin film transistor T7 is electrically coupled to a nth gate signal point Q(n), and a drain and a source are respectively coupled to the first circuit point P1 and the input DC low voltage VSS; a thin film transistor T8, and a gate of the thin film transistor T8 is electrically coupled to a second circuit point K1, and a drain is inputted with a first low frequency clock LC1 or a second low frequency clock LC2, and a source is electrically coupled to the first circuit point P; a thin film transistor T9, and a gate of the thin film transistor T9 is inputted with the first low frequency clock LC1 or the second low frequency clock LC2, and a drain is inputted with the first low frequency clock LC1 or the second low frequency clock LC2, and a source is electrically coupled to the second circuit point K1; the first circuit point P1 can be at high voltage level by being periodically charged by the first low frequency clock LC1 or the second low frequency clock LC2 to control activation of the thin film transistor T5 for keeping the nth horizontal scanning line G(n) at low voltage level in a non-charge period and to prevent the thin film transistor from influence of the gate voltage stress in a long period of time; the thin film transistor T6 and the thin film transistor T7 are activated as the nth gate signal point Q(n) is at high voltage level, and the voltage level at the first circuit point P1 is pulled down to deactivate the thin film transistor T5 for not to affect the charge to the nth horizontal scanning line G(n).

The pull-up controlling circuit module 4 comprises a thin film transistor T10, and a gate of the thin film transistor T10 is inputted with a n−3th gate signal point Q(n−3), and a drain and a source are respectively coupled to a n−2th horizontal scanning line G(n−2) and the nth gate signal point Q(n); and the n−3th gate signal point Q(n−3) controls activation of the thin film transistor T10 in charge of signal transmission between the former and the latter levels in the gate driver on array circuit, and the thin film transistor T10 can control and transmit the n−3th gate signal point Q(n−3) of the n−3th GOA circuit to the present GOA circuit to allow the GOA signal to be transmitted from level to level;

the pull-down circuit module 5 of the nth gate signal point Q(n) comprises a thin film transistor T0, and a gate of the thin film transistor T0 is inputted with a nth clock CK(n), and a drain and a source are respectively coupled to the nth gate signal point Q(n) and the nth horizontal scanning line G(n); the pull-down circuit module 5 of the nth gate signal point Q(n) can keep the nth gate signal point Q(n) at low voltage level in a non-charge period.

A bootstrap capacitor Cb1 with bootstrap function is coupled between the nth gate signal point Q(n) and the nth horizontal scanning line G(n). The voltage level of the nth gate signal point Q(n) can be raised with the coupling effect of the bootstrap capacitor Cb1 when the voltage of the nth horizontal scanning line G(n) is raised. Accordingly, a higher voltage level of the nth gate signal point Q(n) and a smaller RC delay of the GOA charging signal can be obtained.

Figure 4:
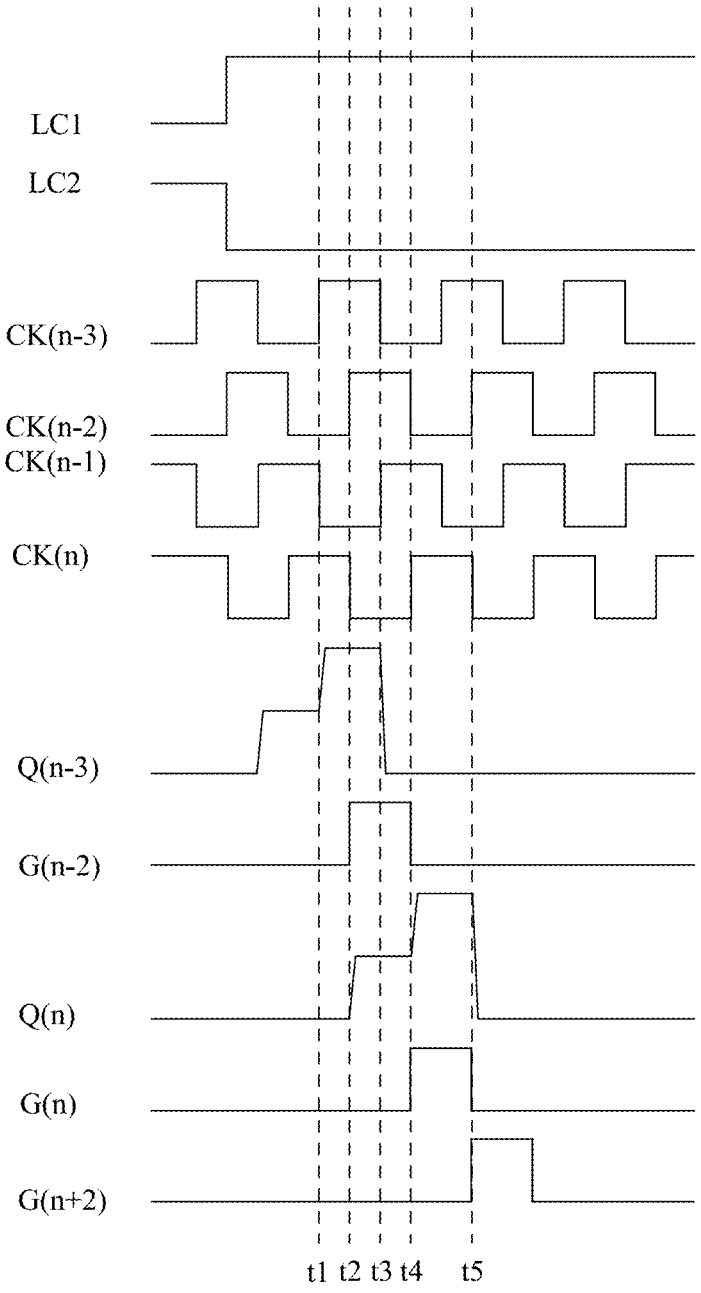
FIG. 4 is a sequence diagram of a complementary GOA circuit employed in panel display according to the present invention.

Only ten thin film transistor elements are present in the GOA circuit unit in the single level structural GOA circuit according to the present invention shown in FIG. 4. On the contrary, fourteen thin film transistor elements are required in a GOA circuit unit of a single level structural GOA circuit employed in panel display according to prior art. Thus, with the complementary method of the pull-down holding circuit module of the GOA circuit at two sides of display panel according to the present invention, the amount of the thin film transistor elements can be decreased.

As shown in FIG. 3, the gate of the thin film transistor T10 in charge of signal transmission between the former and the latter levels is inputted with the n−3th gate signal point Q(n−3), and a source and a drain are respectively coupled to the n−2th horizontal scanning line G(n−2) and the nth gate signal point Q(n); according to the physical knowledge of the semiconductor devices, the voltage difference Vgs between the gate and the source of the thin film transistor T10 must less than the threshold voltage Vth, i.e. Vgs−Vth≥0 if the thin film transistor T10 is required to charge the nth gate signal point Q(n).

Please refer to FIG. 4 in conjunction with FIG. 3. FIG. 4 is a sequence diagram of a complementary GOA circuit employed in panel display according to the present invention. In FIG. 4, t1-t4 are the preparing time before charging of the nth horizontal scanning line G(n), and t4-t5 is the charging time of the G(n). After t5, the nth horizontal scanning line G(n) will be discharged. The procedure of the complementary GOA circuit employed in panel display according to the present invention is: at t1, the voltage level of the n−3th clock CK(n−3) is raised, and the n−3th gate signal point Q(n−3) is bootstrapped to a high voltage level (about two times of the high voltage level of the n−3th horizontal scanning line G(n−3)). However, the n−2th horizontal scanning line G(n−2) which is coupled to the drain of the thin film transistor T10 is at low voltage level and not charged. At t2, the voltage level of the n−2th clock CK(n−2) starts to be raised, and the n−2th horizontal scanning line G(n−2) is charged to be at high voltage level, and the n−3th gate signal point Q(n−3) remains at the bootstrapped high voltage level (which is obviously higher than the high voltage level of the n−2th horizontal scanning line G(n−2)), and the thin film transistor T10 is activated to charge the nth gate signal point Q(n). After the voltage level of the nth gate signal point Q(n) is raised, the thin film transistor T6 and the thin film transistor T7 can be activated to pull down the voltage level of the first circuit point P1 to deactivate the thin film transistor T5 for not to affect the charge to the nth horizontal scanning line G(n). At t3, the voltage level of the n−3th clock CK(n−3) starts to be dropped and the voltage level of the n−3th gate signal point Q(n−3) is dropped, too, and the voltage level of the nth horizontal scanning line G(n) remains at a high voltage level, and the voltage level of the nth gate signal point Q(n) basically maintains unchanged. At t4, the voltage level of the nth clock CK(n) starts to be raised, and the thin film transistor T1 is activated, and the nth gate signal point Q(n) is bootstrapped to a higher voltage level and controls the thin film transistor T1 to charge the nth horizontal scanning line G(n), and the voltage level of the nth horizontal scanning line G(n) is raised. At t5, the voltage level of the nth clock CK(n) starts to be dropped, and the voltage level of the n+2th horizontal scanning line G(n+2) is raised, and the thin film transistor T3 and the thin film transistor T4 are activated to ensure the nth horizontal scanning line G(n) and the nth gate signal point Q(n) to be pulled down to be at the low voltage level. The thin film transistor T6 and the thin film transistor T7 are deactivated after the nth gate signal point Q(n) is pulled down to be dropped. The thin film transistor T4 and the thin film transistor T0 can be normally and periodically activated to keep the nth horizontal scanning line G(n) and the nth gate signal point Q(n) to be at low voltage level in a non-charge period.

As shown in FIG. 4, the n−3th gate signal point Q(n−3) inputted to the gate of the thin film transistor T10 in the pull-up controlling circuit module 4 of the present invention after bootstrap is about two times of the high voltage level $V_{G(n-2)}$ of the n−2th horizontal scanning line G(n−2), i.e. 2 $V_{G(n-2)}$. Therefore, the nth gate signal point Q(n) can be charged to be about $V_{G(n-2)}$ by the thin film transistor T10, and the voltage level of the nth gate signal point Q(n) can be charged to the voltage level which is not easily influenced by the threshold voltage Vth drift of the thin film transistor T10.

Figure 5:
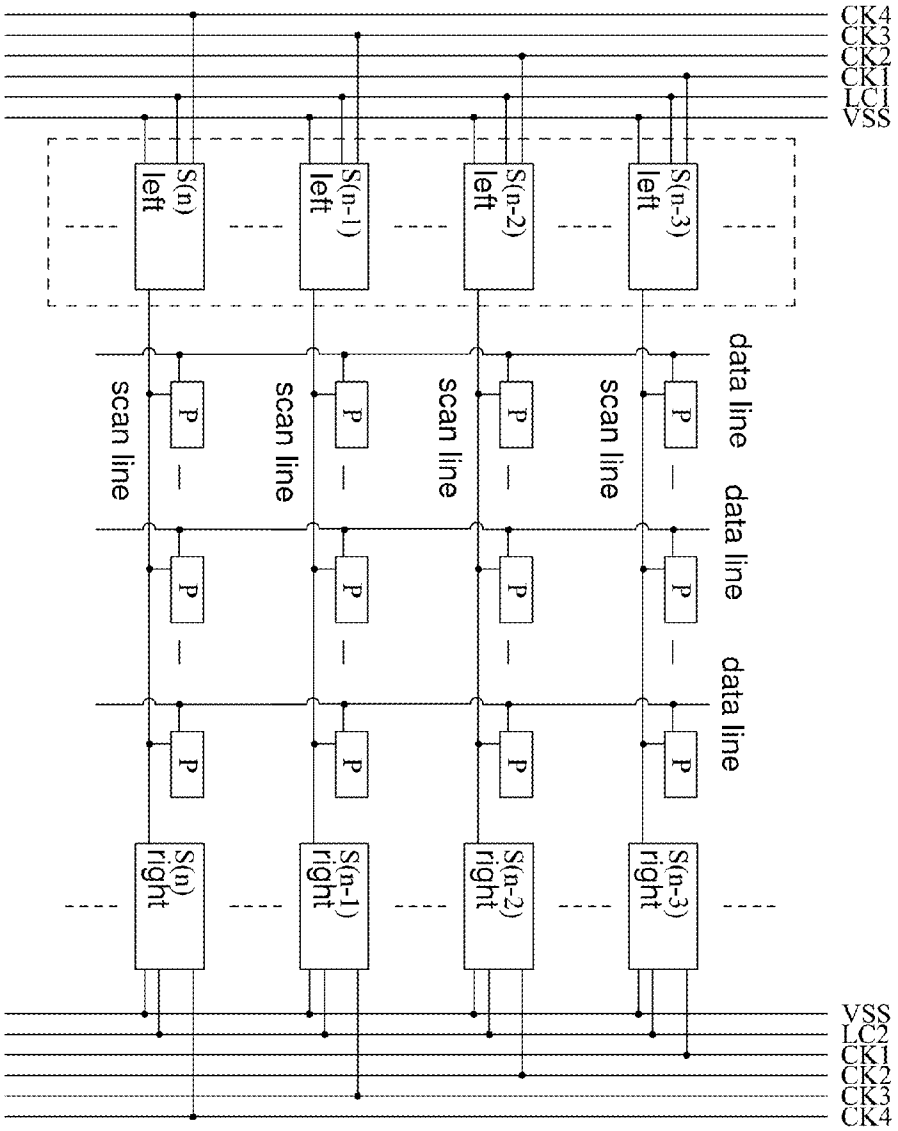
FIG. 5 is a multi-level structural diagram of a complementary GOA circuit employed in panel display according to the present invention.

Please refer to FIG. 5 in conjunction with FIG. 3. FIG. 5 is a multi-level structural diagram of a complementary GOA circuit employed in panel display according to the present invention. FIG. 5 depicts a multi-level connection method of the complementary GOA circuit employed in panel display according to the present invention. Two ends of each gate line in the display area are coupled to the GOA circuit (the single level structural circuit can be refer to FIG. 3), and the GOA circuit can charge or discharge the scan lines from the left side and the right side to achieve the well-proportioned charge effect. The metal lines of a low frequency clock of the first low frequency clock LC1 and the second low frequency clock LC2, a direct current low voltage VSS and four high frequency clock CK1-CK4 are located at the two sides of the panel outside the GOA circuit of the respective levels. A plurality of data lines providing data signals, a plurality of scan lines providing scan signals, a plurality of pixels P are arranged in array, and each of pixel P is electrically coupled to one data line and one scan line, a plurality of shift registers are arranged in sequence S(n−3), S(n−2), S(n−1), S(n). Each shift register outputs a gate signal for scanning the corresponding scan line in the display device. Each shift register is electrically coupled to one of the first low frequency clock LC1 and the second low frequency clock LC2, the direct current low voltage VSS and one of the four high frequency clock CK1-CK4. Specifically, the nth GOA circuit respectively receives one of the first low frequency clock LC1 and the second low frequency clock LC2, the direct current low voltage VSS, one of the four high frequency clock CK1-CK4, a n−2th gate signal generated by the n−2th GOA circuit for scanning the corresponding scan line G(n−2) in the display device, the n−3th gate signal point Q(n−3) generated by the n−3th GOA circuit, a n+2th gate signal generated by the n+2th GOA circuit for scanning the corresponding scan line G(n+2) in the display device, and generates the nth gate signal generated by the nth GOA circuit for scanning the corresponding scan line G(n) in the display device and the nth gate signal point Q(n). The multi-level connection method shown in FIG. 5 can guarantee that the GOA signals can be transmitted from level to level. Moreover, the GOA circuits of respective levels can charge and discharge the horizontal scanning lines in the display area from the left side and the right side from level to level.

Figure 1:
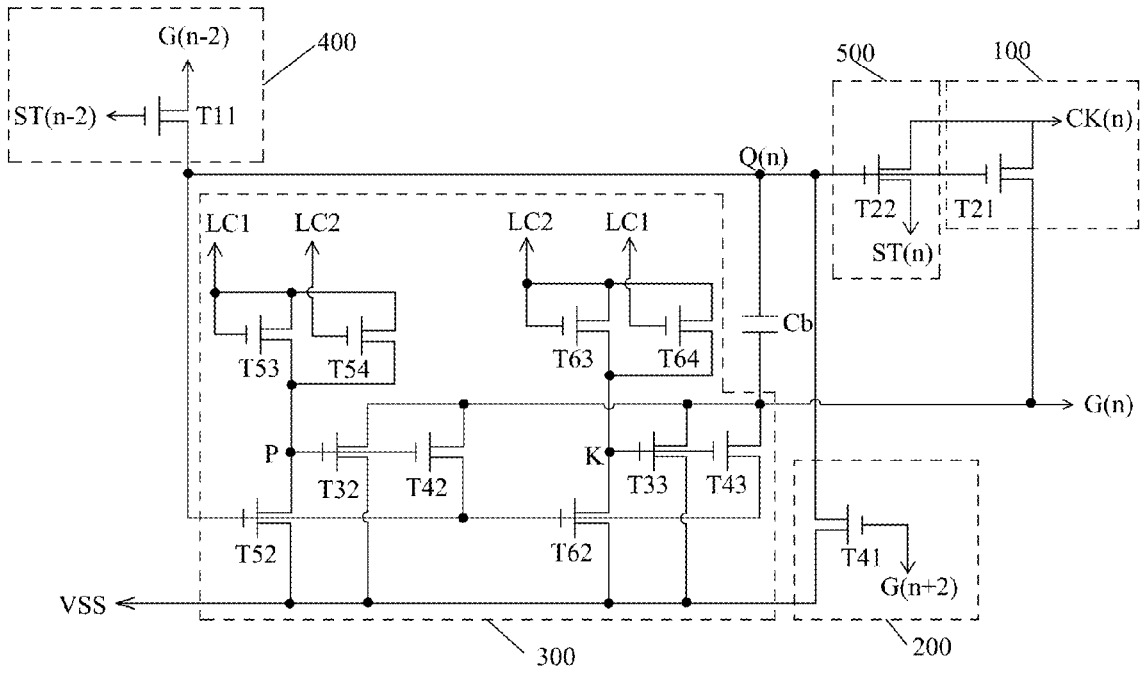
Fig. 1 (Prior Art)
FIG. 1 is a single level structural diagram of a GOA circuit employed in panel display according to prior art.
Figure 2:
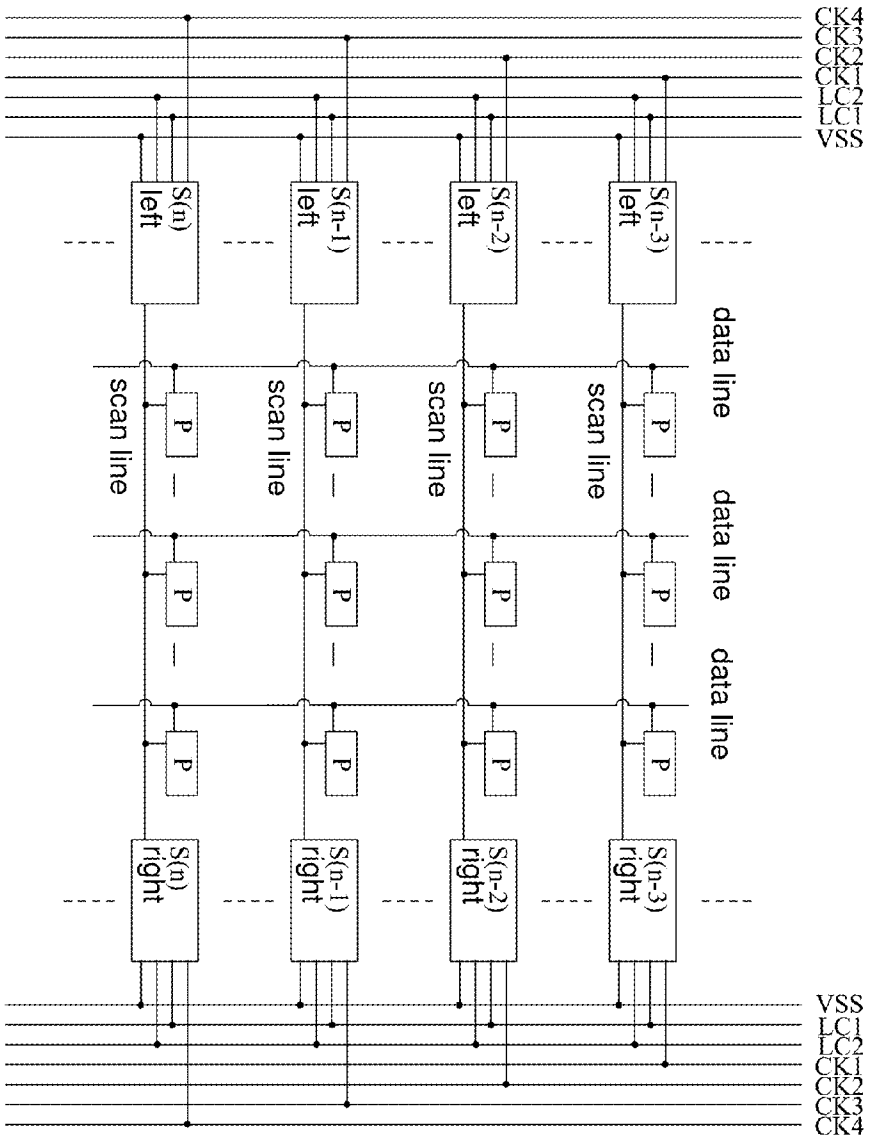
Fig. 2 (Prior Art)
FIG. 2 is a multi-level structural diagram of a GOA circuit employed in panel display according to prior art.

Compared with the GOA circuit shown in FIG. 2 according to prior art, the GOA circuit in FIG. 2 requires two metal lines at both the left side and at the right side for transmitting the first low frequency clock LC1 and the second low frequency clock LC2. Nevertheless, the GOA circuit shown in FIG. 5 according to the present invention merely requires one metal line at the left side and at the right side for transmitting the first low frequency clock LC1 or the second low frequency clock LC2.

Figure 6:
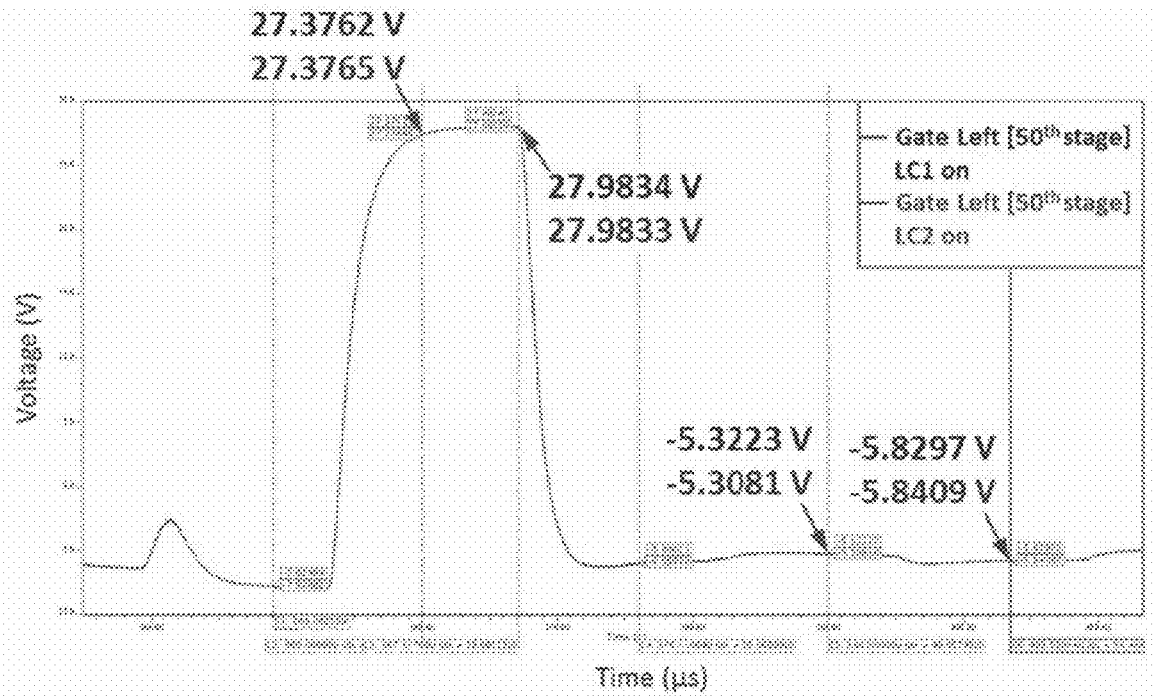
FIG. 6 is a simulation diagram of an output waveform of a complementary GOA circuit employed in panel display according to the present invention.

Please refer to FIG. 6 in conjunction with FIG. 3 and FIG. 5. FIG. 6 is a simulation diagram of an output waveform of a complementary GOA circuit employed in panel display according to the present invention. The utilized simulation software is Eldo SPICE software. According to the present invention, a multi-level GOA circuit is established with the Eldo SPICE software. Meanwhile, the characteristic parameters of the amorphous silicon thin film transistor elements manufactured in some display panel production line are inputted in the software. The output of the nth horizontal scanning line G(n) is simulated as the first low frequency clock LC1 is activated (on state) or as the second low frequency clock LC2 is activated in the GOA circuit. As shown in the simulation diagram in FIG. 6, either as the first low frequency clock LC1 is activated or as the second low frequency clock LC2 is activated, a waveform of the nth horizontal scanning line G(N) can normally output and the waveform of the nth horizontal scanning line G(n) under two conditions are basically coincident. Based on the simulation result of the Eldo SPICE software, the GOA circuit of the present invention is capable of normally charging the scan lines of the display panel.

In a specific embodiment of the present invention, a complementary gate driver on array circuit is provided for a panel display, comprising: a plurality of gate driver on array units which are cascade connected and include a predetermined number of gate driver on array units, wherein for an nth gate driver on array unit where n is an integer in a preset range that is between 1 and the predetermined number, the nth gate driver on array unit controls charge to an nth horizontal scanning line in a display area, and the nth gate driver on array unit comprises a pull-up circuit module, a pull-down circuit module, a pull-down holding circuit module, a pull-up controlling circuit module, a pull-down circuit module of a nth gate signal point, and a bootstrap capacitor; the pull-up circuit module, the pull-down circuit module, the pull-down holding circuit module, the pull-down circuit module of the nth gate signal point, and the bootstrap capacitor are respectively coupled to the nth gate signal point and the nth horizontal scanning line, and the pull-up controlling circuit module is coupled to the nth gate signal point;

wherein the pull-up circuit module comprises: a first thin film transistor directly controlling the charge to the nth horizontal scanning line in the display area, and a gate of the first thin film transistor is electrically coupled to the nth gate signal point, and a source and a drain of the first thin film transistor are respectively inputted with an nth clock and coupled to the nth horizontal scanning line, and a voltage level at the nth gate signal point of the gate of the first thin film transistor directly affects the charge to the nth horizontal scanning line by the nth clock;

wherein the pull-down circuit module comprises: a second thin film transistor discharging the nth horizontal scanning line as the charge is accomplished and a third thin film transistor discharging the nth gate signal point; a gate of the second thin film transistor is electrically coupled to an n+2th horizontal scanning line, and a drain and a source are respectively connected to the nth horizontal scanning line and an input direct-current (DC) low voltage; a gate of the third thin film transistor is electrically coupled to the n+2th horizontal scanning line, and a drain and a source of the third thin film transistor are respectively connected to the nth gate signal point and the input DC low voltage, the second thin film transistor and the third thin film transistor are activated for discharging when the n+2th horizontal scanning line is at a high voltage level;

wherein the pull-down holding circuit module comprises: a fourth thin film transistor, and a gate of the fourth thin film transistor is electrically coupled to a first circuit point, and a drain and a source are respectively coupled to the nth horizontal scanning line and the input DC low voltage; a fifth thin film transistor, and a gate of the fifth thin film transistor is electrically coupled to the nth gate signal point, and a drain and a source are respectively coupled to a second circuit point and the input DC low voltage; a sixth thin film transistor, and a gate of the sixth thin film transistor is electrically coupled to the nth gate signal point, and a drain and a source are respectively coupled to the first circuit point and the input DC low voltage; a seventh thin film transistor, and a gate of the seventh thin film transistor is electrically coupled to the second circuit point, and a drain is inputted with one of a first low frequency clock and a second low frequency clock, and a source is electrically coupled to the first circuit point; an eighth thin film transistor, and a gate of the eighth thin film transistor is connected to the drain of the seventh thin film transistor and is inputted with the one of the first low frequency clock and the second low frequency clock, and a drain is connected with the drain of the seventh thin-film transistor and is inputted with the one of the first low frequency clock and the second low frequency clock, and a source is electrically coupled to the second circuit point;

wherein the first circuit point is at a high voltage level by being periodically charged by the one of the first low frequency clock and the second low frequency clock to control activation of the fourth thin film transistor for keeping the nth horizontal scanning line at a low voltage level in a non-charge period; and the fifth thin film transistor and the sixth thin film transistor are activated as the nth gate signal point is at a high voltage level, and the high voltage level at the first circuit point is pulled down to deactivate the fourth thin film transistor so as not to affect the charge to the nth horizontal scanning line;

wherein the pull-up controlling circuit module comprises a ninth thin film transistor, and a gate of the ninth thin film transistor is inputted with a n−3th gate signal point, and a drain and a source are respectively coupled to a n−2th horizontal scanning line and the nth gate signal point, and the n−3th gate signal point controls activation of the ninth thin film transistor in charge of signal transmission between a previous one and a subsequent one of the gate driver on array units of the gate driver on array circuit;

wherein the pull-down circuit module of the nth gate signal point comprises a tenth thin film transistor, and a gate of the tenth thin film transistor is inputted with the nth clock, and a drain and a source are respectively coupled to the nth gate signal point and the nth horizontal scanning line;

wherein the gate driver on array unit employed ten thin film transistors including the first, second, third, fourth, fifth, sixth, seventh, eighth, ninth, and tenth thin film transistors;

wherein each of a left side and a right side of the panel comprises one single metal line respectively transmit the first low frequency clock and the second low frequency clock;

wherein either when the first low frequency clock is activated or the second low frequency clock is activated, a waveform of the nth horizontal scanning line can normally output and the waveform of the nth horizontal scanning line under two conditions are basically coincident in a simulation of Eldo SPICE software; and wherein n belongs to a subset of the preset range that is between 1 and the predetermined number such that n+2, n−2, and n−3 are all integers of the preset range In conclusion, in the complementary gate driver on array circuit employed for panel display of the present invention, by a method of performing compensation with the pull-down holding circuit modules (G(n) pull down) of the GOA circuit at the left and the right sides of the display panel, the dimension of the pull-down holding circuit module of the GOA circuit can be reduced. Accordingly, the size of the GOA circuit is reduced. The dimension-reduced GOA circuit can be realized. Then, such GOA circuit is applicable for narrow frame or non frame panel display products. Meanwhile, the chance that the GOA circuit area is influenced with the dust in the manufacture processes of the display panel can be decreased and it is beneficial for promoting the yield of the panel. Meanwhile, in comparison with the major method of prior arts, the transmission method between the former and the latter levels according to the present invention is improved. With a n−3th gate signal point Q(n−3) to control activation of the thin film transistor in charge of signal transmission between the former and the latter levels in the GOA circuit, the influence to the signal transmission between the former and the latter levels in the GOA circuit caused by the threshold voltage drift of the thin film transistor can be smaller than the method in prior arts. Therefore, the influence to the output of the GOA circuit caused by the threshold voltage drift of the thin film transistor can get smaller. The GOA circuit of the present invention can be applied for manufacturing the narrow frame or non frame panel display products.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A complementary gate driver on array circuit employed for panel display, comprising:

a plurality of gate driver on array units which are cascade connected and include a predetermined number of gate driver on array units, wherein for an nth gate driver on array unit where n is an integer in a preset range that is between 1 and the predetermined number, the nth gate driver on array unit controls charge to an nth horizontal scanning line in a display area, and the nth gate driver on array unit comprises a pull-up circuit module, a first pull-down circuit module, a pull-down holding circuit module, a pull-up controlling circuit module, a second pull-down circuit module of a nth gate signal point, and a bootstrap capacitor; the pull-up circuit module, the first pull-down circuit module, the pull-down holding circuit module, the second pull-down circuit module of the nth gate signal point, and the bootstrap capacitor are respectively coupled to the nth gate signal point and the nth horizontal scanning line, and the pull-up controlling circuit module is coupled to the nth gate signal point;

wherein the pull-up circuit module comprises a first thin film transistor and the first pull-down circuit module comprises a second thin film transistor and a third thin film transistor;

wherein the pull-down holding circuit module comprises: a fourth thin film transistor, and a gate of the fourth thin film transistor is electrically coupled to a first circuit point, and a drain and a source of the fourth thin film transistor are respectively coupled to the nth horizontal scanning line and an input direct-current (DC) low voltage; a fifth thin film transistor, and a gate of the fifth thin film transistor is electrically coupled to the nth gate signal point, and a drain and a source of the fifth thin film transistor are respectively coupled to a second circuit point and the input DC low voltage; a sixth thin film transistor, and a gate of the sixth thin film transistor is electrically coupled to the nth gate signal point, and a drain and a source of the sixth thin film transistor are respectively coupled to the first circuit point and the input DC low voltage; a seventh thin film transistor, and a gate of the seventh thin film transistor is electrically coupled to the second circuit point, and a drain of the seventh thin film transistor is inputted with one of a first low frequency clock and a second low frequency clock, and a source of the seventh thin film transistor is electrically coupled to the first circuit point;

an eighth thin film transistor, and a gate of the eighth thin film transistor is connected to the drain of the seventh thin film transistor and is inputted with the one of the first low frequency clock and the second low frequency clock, and a drain of the eighth thin film transistor is connected with the drain of the seventh thin-film transistor and is inputted with the one of the first low frequency clock and the second low frequency clock, and a source of the eighth thin film transistor is electrically coupled to the second circuit point;

wherein the first circuit point is at a high voltage level by being periodically charged by the one of the first low frequency clock and the second low frequency clock to control activation of the fourth thin film transistor for keeping the nth horizontal scanning line at a low voltage level in a non-charge period; and the fifth thin film transistor and the sixth thin film transistor are activated as the nth gate signal point is at the high voltage level, and the high voltage level at the first circuit point is pulled down to deactivate the fourth thin film transistor so as not to affect the charge to the nth horizontal scanning line; and wherein n belongs to a subset of the preset range that is between 1 and the predetermined number such that n+2, n−2, and n−3 are all integers of the preset range.

2. The complementary gate driver on array circuit employed for panel display according to claim 1, wherein the pull-up circuit module comprises: the first thin film transistor directly controlling the charge to the nth horizontal scanning line in the display area, and a gate of the first thin film transistor is electrically coupled to the nth gate signal point, and a source and a drain of the first thin film transistor are respectively inputted with an nth clock and coupled to the nth horizontal scanning line, and a voltage level at the nth gate signal point of the gate of the first thin film transistor directly affects the charge to the nth horizontal scanning line by the nth clock.

3. The complementary gate driver on array circuit employed for panel display according to claim 1, wherein the first pull-down circuit module comprises: the second thin film transistor discharging the nth horizontal scanning line as the charge is accomplished and the third thin film transistor discharging the nth gate signal point; a gate of the second thin film transistor is electrically coupled to an n+2th horizontal scanning line, and a drain and a source of the second thin film transistor are respectively connected to the nth horizontal scanning line and the input direct-current (DC) low voltage; a gate of the third thin film transistor is electrically coupled to the n+2th horizontal scanning line, and a drain and a source of the third thin film transistor are respectively connected to the nth gate signal point and the input DC low voltage, the second thin film transistor and the third thin film transistor are activated for discharging when the n+2th horizontal scanning line is at the high voltage level.

4. The complementary gate driver on array circuit employed for panel display according to claim 1, wherein the pull-up controlling circuit module comprises a ninth thin film transistor, and a gate of the ninth thin film transistor is inputted with an n−3th gate signal point, and a drain and a source of the ninth thin film transistor are respectively coupled to an n−2th horizontal scanning line and the nth gate signal point, and the n−3th gate signal point controls activation of the ninth thin film transistor in charge of signal transmission between a previous one and a subsequent one of the gate driver on array units of the gate driver on array circuit.

5. The complementary gate driver on array circuit employed for panel display according to claim 1, wherein the second pull-down circuit module of the nth gate signal point comprises a tenth thin film transistor, and a gate of the tenth thin film transistor is inputted with a nth clock, and a drain and a source of the tenth thin film transistor are respectively coupled to the nth gate signal point and the nth horizontal scanning line.

6. The complementary gate driver on array circuit employed for panel display according to claim 1, wherein the nth gate driver on array unit comprises ten thin film transistors.

7. The complementary gate driver on array circuit employed for panel display according to claim 1, wherein each of a left side and a right side of the panel comprises one single metal line to respectively transmit the first low frequency clock and the second low frequency clock.

8. The complementary gate driver on array circuit employed for panel display according to claim 1, wherein either as the first low frequency clock is activated or as the second low frequency clock is activated, a waveform of the nth horizontal scanning line can be normally output and the waveform of the nth horizontal scanning line under two conditions are basically coincident in a simulation.

9. A complementary gate driver on array circuit employed for panel display, comprising:

a plurality of gate driver on array units which are cascade connected and include a predetermined number of gate driver on array units, wherein for an nth gate driver on array unit where n is an integer in a preset range that is between 1 and the predetermined number, the nth gate driver on array unit controls charge to an nth horizontal scanning line in a display area, and the nth gate driver on array unit comprises a pull-up circuit module, a first pull-down circuit module, a pull-down holding circuit module, a pull-up controlling circuit module, a second pull-down circuit module of a nth gate signal point, and a bootstrap capacitor; the pull-up circuit module, the first pull-down circuit module, the pull-down holding circuit module, the second pull-down circuit module of the nth gate signal point, and the bootstrap capacitor are respectively coupled to the nth gate signal point and the nth horizontal scanning line, and the pull-up controlling circuit module is coupled to the nth gate signal point;

wherein the pull-up circuit module comprises: a first thin film transistor directly controlling the charge to the nth horizontal scanning line in the display area, and a gate of the first thin film transistor is electrically coupled to the nth gate signal point, and a source and a drain of the first thin film transistor are respectively inputted with an nth clock and coupled to the nth horizontal scanning line, and a voltage level at the nth gate signal point of the gate of the first thin film transistor directly affects the charge to the nth horizontal scanning line by the nth clock;

wherein the first pull-down circuit module comprises: a second thin film transistor discharging the nth horizontal scanning line as the charge is accomplished and a third thin film transistor discharging the nth gate signal point; a gate of the second thin film transistor is electrically coupled to an n+2th horizontal scanning line, and a drain and a source of the second thin film transistor are respectively connected to the nth horizontal scanning line and an input direct-current (DC) low voltage; a gate of the third thin film transistor is electrically coupled to the n+2th horizontal scanning line, and a drain and a source of the third thin film transistor are respectively connected to the nth gate signal point and the input DC low voltage, the second thin film transistor and the third thin film transistor are activated for discharging when the n+2th horizontal scanning line is at a high voltage level;

wherein the pull-down holding circuit module comprises: a fourth thin film transistor, and a gate of the fourth thin film transistor is electrically coupled to a first circuit point, and a drain and a source of the fourth thin film transistor are respectively coupled to the nth horizontal scanning line and the input DC low voltage; a fifth thin film transistor, and a gate of the fifth thin film transistor is electrically coupled to the nth gate signal point, and a drain and a source of the fifth thin film transistor are respectively coupled to a second circuit point and the input DC low voltage; a sixth thin film transistor, and a gate of the sixth thin film transistor is electrically coupled to the nth gate signal point, and a drain and a source of the sixth thin film transistor are respectively coupled to the first circuit point and the input DC low voltage; a seventh thin film transistor, and a gate of the seventh thin film transistor is electrically coupled to the second circuit point, and a drain of the seventh thin film transistor is inputted with one of a first low frequency clock and a second low frequency clock, and a source of the seventh thin film transistor is electrically coupled to the first circuit point; an eighth thin film transistor, and a gate of the eighth thin film transistor is connected to the drain of the seventh thin film transistor and is inputted with the one of the first low frequency clock and the second low frequency clock, and a drain of the eighth thin film transistor is connected with the drain of the seventh thin-film transistor and is inputted with the one of the first low frequency clock and the second low frequency clock, and a source of the eighth thin film transistor is electrically coupled to the second circuit point;

wherein the first circuit point is at the high voltage level by being periodically charged by the one of the first low frequency clock and the second low frequency clock to control activation of the fourth thin film transistor for keeping the nth horizontal scanning line at a low voltage level in a non-charge period; and the fifth thin film transistor and the sixth thin film transistor are activated as the nth gate signal point is at the high voltage level, and the high voltage level at the first circuit point is pulled down to deactivate the fourth thin film transistor so as not to affect the charge to the nth horizontal scanning line;

wherein the pull-up controlling circuit module comprises a ninth thin film transistor, and a gate of the ninth thin film transistor is inputted with a n−3th gate signal point, and a drain and a source of the ninth thin film transistor are respectively coupled to a n−2th horizontal scanning line and the nth gate signal point, and the n−3th gate signal point controls activation of the ninth thin film transistor in charge of signal transmission between a previous one and a subsequent one of the gate driver on array units of the gate driver on array circuit;

wherein the second pull-down circuit module of the nth gate signal point comprises a tenth thin film transistor, and a gate of the tenth thin film transistor is inputted with the nth clock, and a drain and a source of the tenth thin film transistor are respectively coupled to the nth gate signal point and the nth horizontal scanning line;

wherein the nth gate driver on array unit employed ten thin film transistors including the first, second, third, fourth, fifth, sixth, seventh, eighth, ninth, and tenth thin film transistors;

wherein each of a left side and a right side of the panel comprises one single metal line respectively transmit the first low frequency clock and the second low frequency clock;

wherein either when the first low frequency clock is activated or the second low frequency clock is activated, a waveform of the nth horizontal scanning line can be normally output and the waveform of the nth horizontal scanning line under two conditions are basically coincident in a simulation; and wherein n belongs to a subset of the preset range that is between 1 and the predetermined number such that n+2, n−2, and n−3 are all integers of the preset range.

* * * * *